United States Patent [19]

Koch

[11] 4,015,639

[45] Apr. 5, 1977

[54] HEDDLE FRAME WITH LATERALLY DISPLACED LATERAL SUPPORTS

[75] Inventor: Bernhard R. Koch, Horgenberg, Switzerland

[73] Assignee: Grob & Co. Aktiengesellschaft, Horgen, Switzerland

[22] Filed: Aug. 11, 1975

[21] Appl. No.: 603,902

[30] Foreign Application Priority Data

Aug. 12, 1974 Switzerland ..... 10971/74

[52] U.S. Cl. ..... 139/92

[51] Int. Cl.[2] ..... D03C 9/06

[58] Field of Search ..... 139/91, 92, 82

[56] References Cited

UNITED STATES PATENTS

| | | | |
|---|---|---|---|
| 2,037,381 | 4/1936 | Kaufmann | 139/92 |
| 2,556,468 | 6/1951 | Consoletti | 139/92 |
| 2,877,803 | 3/1959 | Maruyama | 139/92 |
| 2,981,293 | 4/1961 | Nussbaum | 139/91 |
| 3,221,777 | 12/1965 | Koch | 139/92 |
| 3,258,035 | 6/1966 | Fend | 139/92 |
| 3,693,667 | 9/1972 | Arnold | 139/91 |
| 3,753,450 | 8/1973 | Koch | 139/91 |

FOREIGN PATENTS OR APPLICATIONS

| | | | |
|---|---|---|---|
| 2,126,074 | 12/1972 | Germany | 139/91 |
| 365,039 | 11/1962 | Switzerland | 139/92 |
| 1,201,688 | 8/1970 | United Kingdom | 139/92 |

*Primary Examiner*—James Kee Chi

*Attorney, Agent, or Firm*—Sughrue, Rothwell, Mion, Zinn & Macpeak

[57] ABSTRACT

A heddle frame is provided with a frame stave having a heddle carrying rod connected to and disposed below the stave in spaced parallel relation. The ends of the frame stave are connected to lateral supports in such a manner that the lateral supports will be offset from the ends of said heddle carrying rod to allow for the placing on and removal of heddles on said rod without interfering with the lateral supports. Pivoted locking levers ae provided adjacent each end of the rod to selectively allow the placing on and removal of heddles on said rod.

5 Claims, 5 Drawing Figures

HEDDLE FRAME WITH LATERALLY DISPLACED LATERAL SUPPORTS

BACKGROUND OF THE INVENTION

In prior art heddle frames, the frame staves with mounted heddle carrying rods are kept in their positions at their ends by means of lateral supports. The heddle carrying rods on which the heddles are lined up are disposed with their ends in contact with the lateral supports where locking devices, of which there are several variations, hinder the heddles from sliding off the heddle carrying rods.

In order to place heddles on or to remove heddles from the heddle carrying rods, the ends of the heddle carrying rods are usually loosened from the locking devices and swivelled out of the plane surface of the heddle frame until the ends of the heddle carrying rods are freely accessible. On modern heddle frame designs, the heddle carrying rods are so rigidly connected with the frame stave that only with great effort can they be loosened or swivelled out at their ends. In such cases it is necessary to remove the lateral support or to loosen it in such a way that it can be swivelled away from the ends of the heddle carrying rods in order to place or to remove the heddles.

SUMMARY OF THE INVENTION

The principal object of the invention is to eliminate the aforementioned disadvantages and to provide a heddle frame that can be prepared for the placing or removing of heddles in the shortest possible time. The invention attains this objective in that the lateral supports are laterally displaced relative to the planar surface of the heddle frame and that the heddle frame is provided with locking devices which, when closed, hinder the heddles from sliding off the heddle carrying rods and, when open, allow the heddles to be slid on or off the heddle carrying rods, the ends of which are offset from the lateral support.

The rigid connection between the frame stave and lateral support is made appropriately in such a way that a laterally displaced fitting plate is mounted on the side support. An insert, which is provided with two studs and a tap hole, is mounted in the known manner in the hollow base at the end of the frame stave and is permanently connected with it. The plate and insert are connected to each other by means of a screw while the studs project into the respective guiding holes in the plate and keep the frame stave in the aligned position.

The locking device is preferably designed as a pivoted lever which can be swivelled into open and locked positions. The final positions of the pivoted lever can be limited by stop faces or by ratching elements engaging notches on the lever. The pivot for the lever can either be arranged on the frame stave or on a flange on the mounting plate of the lateral supports.

The foregoing and other objects, features and advantages of the invention will be apparent from the following more particular description of preferred embodiments of the invention as illustrated in the accompanying drawings.

DETAILED DESCRIPTION OF THE INVENTION

Figure 1:
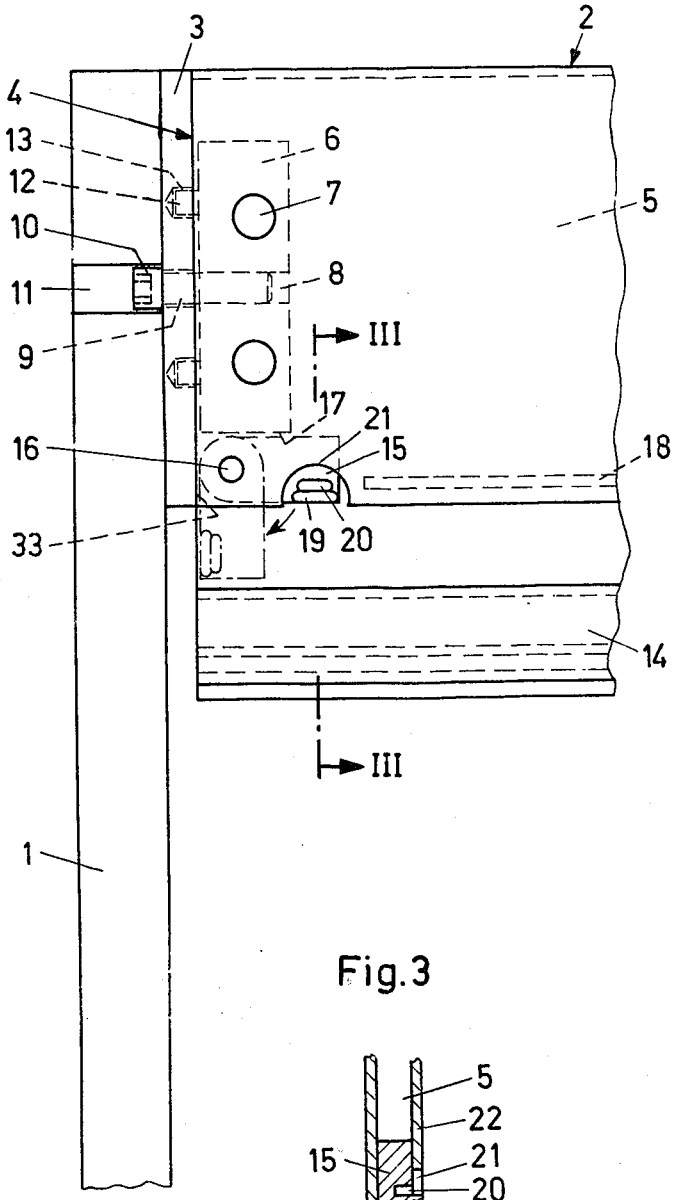
FIG. 1 is a front view of a connection between an upper frame stave and a lateral support.
Figure 2:
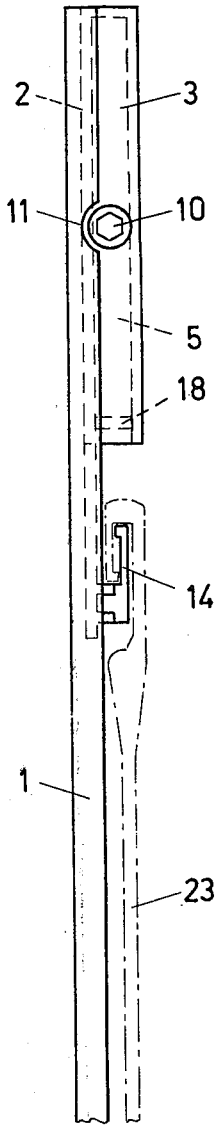
FIG. 2 is a side view of FIG. 1.
Figure 3:
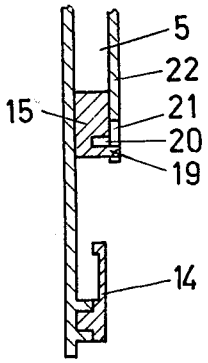
FIG. 3 is a partial sectional view taken along the Line III—III in FIG. 1.

In FIGS. 1, 2 and 3 the lateral support 1 is shown connected to the frame stave 2 which is shaped as a hollow profile with a rectangular cross-section. Each lateral support 1 has a mounting plate 3 which cover the sides 4 of the frame staves 2 in the region of the hollow base 5. The mounting plates 3 are so arranged that they protrude unilaterally on the lateral support 1 so that the latter, in mounted position, will be displaced relative to the plane surface of the heddle frame. In this manner the lateral support 1 will be offset from the ends of the heddle carrying rod 14 in order to permit the placement and/or removal of the heddles. To achieve a rigid connections of the lateral support 1, an insert 6 is mounted in the hollow space 5 and is secured therein by means of two rivets 7. The insert 6 is provided with a tap hole 8 into which the screw 9, passing through the mounting plate 3, is threaded. In order to place the screw 9 through the center of the insert 6, a recession 11 is provided in the displaced lateral support 1 for the screw head 10. To stabilize the connection which is made by only one screw 9, the insert 6 is additionally provided with two studs 12 which protrude into two holes 13 of the mounting plate 3.

FIG. 1, the locking device which hinders the heddles 23 from sliding off the heddle carrying rod 14, is shown as a pivoted lever 15. The pivoted lever 15 can be swivelled on the pivot 16 which is pressed into the frame stave profile 2. IN order to line up the heddles 23, the pivoted lever 15 will be swivelled into the hollow space 5 of the frame stave profile 2. The lateral face 17 of the insert 6 forms, in this position, the limit stop for the pivoted lever 15. In order to obtain the necessary free space for the pivoted lever 15 in the hollow space 5, the rib 18 of the frame stave profile 2 is milled in this region. After lining up of heddles 23, the pivoted lever 15 is swivelled in the direction of the arrow. In this position, the mounting plate 3 serves as limit stop 33 for the pivoted lever 15.

On the pivoted lever 15 there is a notch 19 in order to facilitate its operation by hand. Additionally a recess 20 is provided into which a tool, for instance a screw driver, can be inserted in order to swivel the pivoted lever 15. So that the operating elements 19, 20 of the pivoted lever 15 can be reached when the latter is in its swivelled-in position, the side wall 22 of the frame stave profile 2 is provided with a recess 21.

Figure 4:
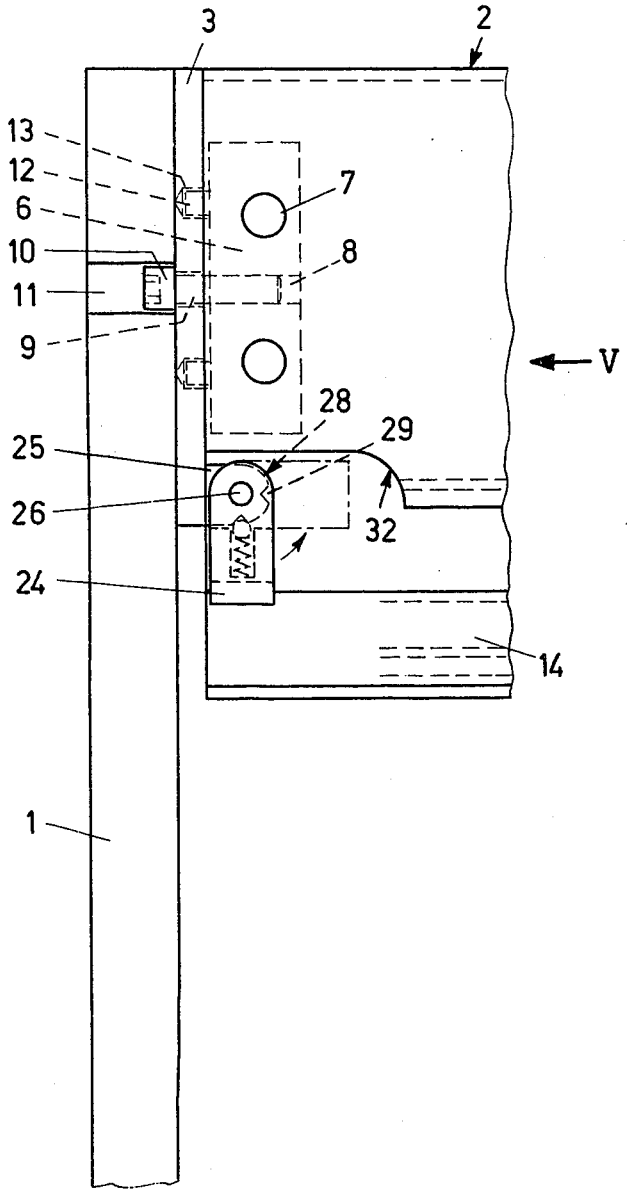
FIG. 4 is a front view of a different embodiment of the connection between a frame stave and a lateral support.
Figure 5:
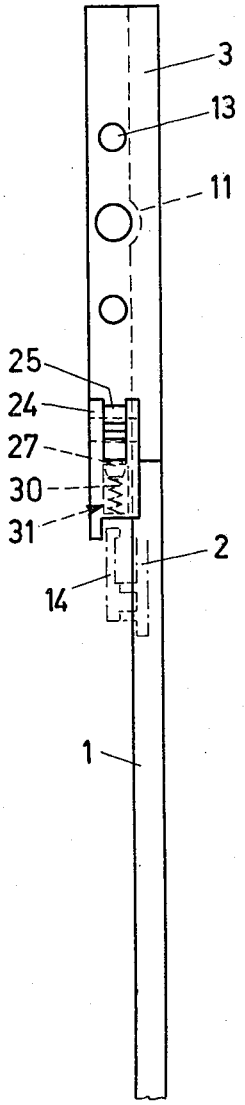
FIG. 5 is a side view of FIG. 4 as seen from the direction of arrow V drawn without a frame stave.

In the embodiment according to FIGS. 4 and 5, the locking device is also shaped as a pivoted lever 24. However, this time it is arranged on plate 25 which is secured on the mounting plate 3 of the laterally displaced lateral support 1. The lever 24 is shaped as a fork joint and swivels on the bolt 26 which is pressed into the plate 25. The pivoted lever 24 can be swivelled up and down in the direction of the arrow.

The limitation of the end positions is achieved by means of a ball 27 which presses under spring tension into the notches 29 arranged in the circular surface 28. The ball 27 catches into the respective notches resulting in the respective stop positions. The ball 27 as well as the spring 30 which produces the necessary pressure, are inserted in a bore 31 inside the pivoted lever 24. In order to carry out the swivelling movement with the lever 24, a recess 32 on the frame stave profile 2 has to be made which allows the necessary free play.

Since the lateral supports are laterally displaced, the heddles can be slid off from the ends of the heddle carrying rods past the lateral supports easily without changes of the heddle frame. This solution to the object of the invention was not obvious since, in most cases, the lateral supports of neighboring heddle frames glide on each other and, therefore, leave no free space. Therefore in the present invention, the lateral supports of a heddle frame are laterally displaced from the plane surface of a heddle frame.

Sine the lateral supports of adjacent heddle frames no longer glide on each other it is necessary that the other guides will keep the heddle frames in their working position. Through this changeover, however, a great saving of the daily work on the heddle frames can be obtained referring in particular to adding or removing heddles from the heddle frames. It is only necessary to open a very simple locking device on the heddle frames which allows an easy removing or placing of heddles onto the heddle carrying rods. Currently used rods that can be connected to the heddle carrying rods facilitate this work.

What is claimed is:

1. A heddle frame comprising lateral supports, an elongated frame stave, mounting means securing opposite ends of said stave to said supports, a heddle carrying rod connected to and disposed below said stave in spaced parallel relation thereto in a common vertical plane, said rod being co-extensive in length with said stave, said mounting means comprising a mounting plate secured to each end of said stave at right angles thereto, and said lateral supports being secured to right opposite faces of said plates and disposed in a vertical plane laterally offset relative to the vertical plane of said stave and rod to expose the ends of said rod to enable heddles to be placed on and removed from the ends of said rod without interference by said supports.

2. A heddle frame according to Claim 1 wherein said frame stave is provided with a hollow space at each end of said frame stave, an insert secured in each space and having a threaded bore and a pair of studs protruding beyond the end of said stave, three apertures located in said plate, and bolt means extending through one of said apertures into threaded engagement with said bore with said studs being disposed in the remaining apertures.

3. A heddle frame according to claim 2 further including a locking lever for selectively preventing the placing on and removal of heddles on said rod.

4. The heddle frame according to claim 3 wherein said lever is pivoted on said frame stave adjacent an end thereof for movement between an open position wherein said lever is swivelled into said hollow space in the frame stave and a locking position wherein the lever is disposed in blocking engagement adjacent an end of said rod.

5. A heddle frame according to claim 3 further comprising a flange secured to an extending from said mounting plate, said lever being pivoted on said flange between an open position wherein the lever is swivelled into the hollow space in said frame stave and a locking position wherein the lever is disposed adjacent the end of said rod, said positions being defined by spring biased detent means.

* * * * *